US007712542B2

(12) United States Patent
Munroe

(10) Patent No.: US 7,712,542 B2
(45) Date of Patent: May 11, 2010

(54) FIRE SUPPRESSION SYSTEM

(76) Inventor: David B. Munroe, 4 Grafton St., Coventry, RI (US) 02816

( * ) Notice: Subject to any disclaimer, the term of this patent is extended or adjusted under 35 U.S.C. 154(b) by 81 days.

(21) Appl. No.: 11/476,244

(22) Filed: Jun. 28, 2006

(65) Prior Publication Data

US 2007/0114046 A1 May 24, 2007

Related U.S. Application Data

(60) Provisional application No. 60/737,918, filed on Nov. 18, 2005, provisional application No. 60/764,501, filed on Feb. 1, 2006.

(51) Int. Cl.
*A62C 35/00* (2006.01)

(52) U.S. Cl. ..... 169/14; 169/15; 169/16; 169/60; 169/5

(58) Field of Classification Search ..... 169/14, 169/15, 16, 17, 24, 56, 60, 5, 19
See application file for complete search history.

(56) References Cited

U.S. PATENT DOCUMENTS

| | | | | |
|---|---|---|---|---|
| 278,216 | A | | 5/1883 | Brown |
| 903,788 | A | | 11/1908 | Schmidt |
| 2,493,982 | A | | 1/1950 | Lee |
| 3,067,823 | A | | 12/1962 | Kavanagh |
| 3,441,086 | A | | 4/1969 | Bames |
| 4,474,680 | A | | 10/1984 | Kroll et al. |
| 4,505,431 | A | | 3/1985 | Huffman |
| 4,601,345 | A | | 7/1986 | Mahrt |
| 4,981,178 | A | | 1/1991 | Bundy |
| 5,255,747 | A | * | 10/1993 | Teske et al. ..... 169/15 |
| 5,411,100 | A | * | 5/1995 | Laskaris et al. ..... 169/14 |
| 5,441,113 | A | | 8/1995 | Pierce |
| 5,623,995 | A | | 4/1997 | Smagac |
| 5,632,338 | A | | 5/1997 | Hunter |
| 5,645,223 | A | | 7/1997 | Hull et al. |
| 5,720,351 | A | * | 2/1998 | Beukema et al. ..... 169/61 |
| 5,881,817 | A | | 3/1999 | Mahrt |
| 6,082,463 | A | | 7/2000 | Ponte |
| 6,086,052 | A | * | 7/2000 | Rowe ..... 261/18.1 |

(Continued)

OTHER PUBLICATIONS

International Search Report in PCT/US 06/44306 dated Apr. 5, 2007.

(Continued)

*Primary Examiner*—Dinh Q Nguyen
(74) *Attorney, Agent, or Firm*—Edwards Angell Palmer & Dodge LLP; George N. Chaclas

(57) ABSTRACT

A fire suppressant system having a pipe system, spray nozzles connected to the pipe system and a control system for selectively charging the pipe system with foam. The control system includes a pilot line for generating a signal based upon sensing an environmental parameter and a first control valve for activating the system based upon the signal. Preferably, the first control valve forms i) an interior cavity for mixing the compressed air and compressed air liquid, ii) an outlet in fluid communication with the interior; iii) a first inlet, oriented substantially perpendicular to a flow through the outlet, in fluid communication with the interior and the compressed air; and iv) a second inlet, oriented substantially perpendicular to the flow, in fluid communication with the interior and the compressed air liquid.

15 Claims, 14 Drawing Sheets

U.S. PATENT DOCUMENTS

| | | | | |
|---|---|---|---|---|
| 6,089,324 | A | 7/2000 | Mahrt | |
| 6,328,225 | B1 | 12/2001 | Crampton | |
| 2004/0089457 | A1 * | 5/2004 | Ballu | 169/16 |

OTHER PUBLICATIONS

Written Opinion in PCT/US 06/44306 dated Apr. 5, 2007.
Crampton, et al, "A New Fire Suppression Technology"; NFPA Journal, Jul./Aug. 1999.
NRCC, "NRC Fire Suppression Technology now on the Market", Apr. 1, 2005.
NRCC, "Compressed air foam an IRC commercialization success story"; Construction Innovation v10 No. 2, Jun. 2005.
NRCC, "Discovery Channel Visits NRC", Nov. 24, 2003.
FireFlex Systems, Inc., "Integrated Compressed Air Foam Systems for Fixed Piping Network", ICAF Marketing brochure, Jan. 20, 2005.
Asselin, et al, "The Emergence of CAF fixed-pipe fire suppression systems"; ICAF Spring 2005.
NFPA News; vol. 8 No. 1—Jan./Feb. 2004.
NFPA News; vol. 9 No. 10—Nov. 2005.
Excerpt from FM Approvals—Approval Guide May 2005.
FireFlex Systems, Inc., "Integrated Compressed Air Foam Systems for Fixed Piping Network", ICAF Design Manual, Sep. 2004.
Modec's CAF Tac-Pac.

* cited by examiner

FIRE SUPPRESSION SYSTEM

CROSS-REFERENCE TO RELATED APPLICATION

This application claims priority to U.S. Provisional Patent Application No. 60/737,918, filed Nov. 18, 2005, and U.S. Provisional Patent Application No. 60/764,501 filed Feb. 1, 2006, each of which is incorporated herein by reference.

BACKGROUND OF THE INVENTION

1. Field of the Invention

The subject disclosure relates to systems for automatic fire suppression, and more particularly to an improved system for automatically delivering compressed air foam (CAF) to a hazard area that is typically difficult to safely and properly access. The systems are also effective for delivering foam and like substances to cover and control biohazards.

2. Background of the Related Art

For centuries, man has battled unwanted fires. As technology has developed, the fire fighting techniques have matured from the bucket brigade to highly specialized vehicles, systems and chemicals. However, in many instances such as off-shore drilling platforms, boats, bulldozers and the like, access to water distribution networks or access by firefighting vehicles is not available along with other technical challenges. When a fire is relatively small, use of portable fire extinguishers is common. Further, depending upon the source of the fire, water may not be an appropriate agent for suppression. As such, emergency vehicles and portable extinguishers often deliver foam, non-water solutions, water with chemical additives for additional suppression capability and the like.

Use of portable extinguishers from hand-held versions and larger cart-like versions have been widely used and well understood in the art. For example, U.S. Pat. Nos. 5,881,817 and 6,089,324 to Mahrt, each of which is incorporated herein by reference, disclose a portable fire suppression system using cold compressed air foam. The portable system includes a manifold with a mixing chamber for expanding and accelerating the foam through the manifold by injecting cold compressed air adjacent the manifold inlet and at a 68 degree angle relative to the flow direction.

Technology continues to evolve in the area of fire suppression. An exemplary technique is illustrated in U.S. Pat. No. 6,328,225 to Crampton (the Crampton patent), which is incorporated herein by reference. The Crampton patent discloses a rotary nozzle for a CAF fire extinguishing system. In a preferred embodiment, two orifices of unequal size are provided on opposite sides of the lower part of a tubular barrel with closed ends. As a result of the asymmetrical disposition of the two orifices with respect to the axis of rotation of the barrel, jets are directed downwards, tangentially to the axis of rotation of the barrel, causing the barrel to rotate about its axis.

Another exemplary device is disclosed in U.S. Pat. No. 6,082,463 to Ponte (the Ponte patent), which is incorporated herein by reference. The Ponte patent discloses a concealed or covered sprinkler for a conventional (e.g., water-supplied) fire prevention system. When the ambient temperature exceeds the melting point of a solder joint, leaf springs force the sprinkler cover open and, moreover, when the ambient temperature exceeds the release temperature of a thermally responsive structure, a lever structure forces a cap from an orifice through which pressurized water is forced.

U.S. Pat. No. 5,441,113 to Pierce, incorporated herein by reference, discloses an automatic foam fire extinguishing system comprising a source of pressurized foam, a distribution system for distributing air and the foam, and a plurality of sprinkler heads that dispense the air and foam.

U.S. Pat. No. 3,441,086 to Barnes, incorporated herein by reference, discloses a water-powered fire-fighting foam generator and a dispensing nozzle. In a preferred embodiment, pressurized foam solution travels through a passageway into a pair of reaction nozzles that spray the foam solution onto the inner surface of a perforated, cylindrical wall. The force of the solution causes the reaction nozzles and, consequently, the axial flow fan to rotate. As the axial flow fan rotates, it forces air down and then radially outward through the perforations in the cylindrical wall.

Further, advances in technology are often gained by study and use of hazardous or infectious materials such as carcinogens and active virus cultures. As a result of handling such highly toxic and/or dangerous substances, suppression systems are needed to cover and/or control such substances. Although effective suppressants have been developed, an improved system for delivering these suppressants is needed.

SUMMARY OF THE INVENTION

Despite these advances, there are problems associated with the prior art. Manual fire extinguishers are very mobile but if the fire is consuming the area, danger, injury and even death must be risked by the personnel in their efforts to deploy the fire suppressant. Further, the delivery mechanism have control mechanisms that are unduly complex and damage the fire suppressing properties of CAF when passed therethrough.

In view of the above, there is a need for an improved fire suppression system which automatically activates with a simple, effective and reliable trigger mechanism to remove the danger of human operation. Further, a fire suppression system that is fully mobile for application on boats, other vehicles and locations without access to water distribution. Preferably, the system has a simple yet effective control mechanism for activation. Moreover, the system would prevent significant property damage. Preferably, the fire suppression system delivers a clean agent such as CAF that will cling to vertical surfaces and cools to prevent reflash. Further, a nozzle for delivering CAF and use in the trigger mechanism that has reliable operation in response to a change in an environmental parameter would be an improvement over the prior art.

In another embodiment, the system is used to cover and control one or more biohazards in an environment such as a laboratory.

In another embodiment, the system is design to vigorously generate CAF for release while being a simple and efficient design.

In one embodiment, the system distributes foam over a hazard area and includes a pipe system, a plurality of spray nozzles connected to the pipe system for delivering a pattern of the fire suppressant to the hazard area and a control system connected to the pipe system for selectively charging the pipe system with the foam, wherein the control system includes a pilot line connected to the control system for generating a signal based upon sensing at least one environmental parameter and a first control valve for activating the system based upon the signal. Preferably, the environmental parameter is selected from the group consisting of heat, smoke, $CO_2$ level and combinations thereof. It is further preferably that the first control valve forms i) an interior cavity for mixing the compressed air and compressed air liquid, ii) an outlet in fluid communication with the interior; iii) a first inlet, oriented substantially perpendicular to a flow through the outlet, in fluid communication with the interior and the compressed air; and iv) a second inlet, oriented substantially perpendicular to the flow, in fluid communication with the interior and the compressed air liquid.

It should be appreciated that the present invention can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the accompanying drawings.

DETAILED DESCRIPTION OF PREFERRED EMBODIMENTS

Figure 1:
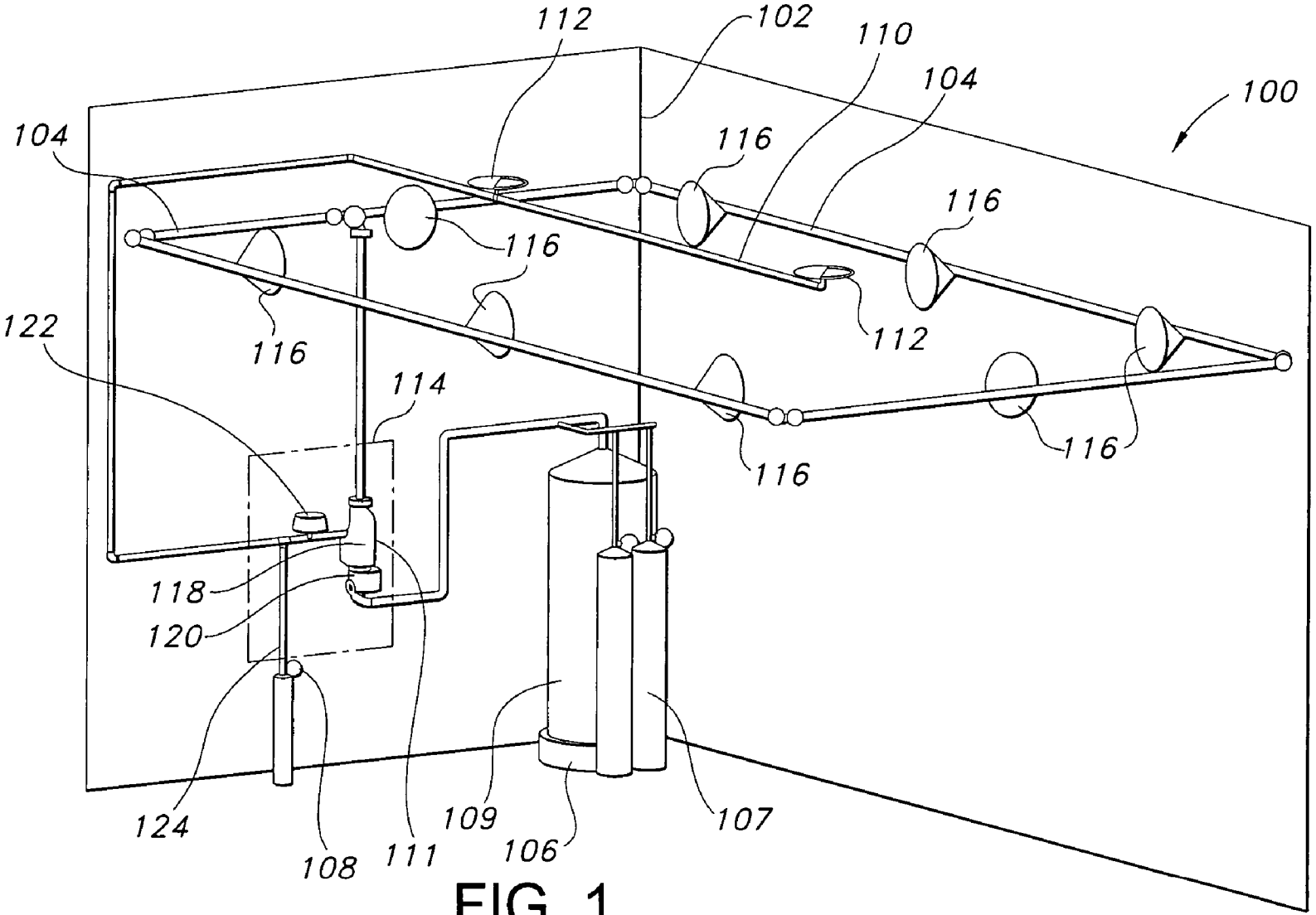
FIG. 1 illustrates a system for distributing a suppressant over a hazard area in accordance with the subject technology.

The present invention overcomes many of the prior art problems associated with suppression systems for fire, biohazards and the like. The advantages, and other features of the systems disclosed herein, will become more readily apparent to those having ordinary skill in the art from the following detailed description of certain preferred embodiments taken in conjunction with the drawings which set forth representative embodiments of the present invention and wherein like reference numerals identify similar structural elements whenever possible.

Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are illustrative and exemplary, and unless otherwise specified, can be altered without materially affecting or limiting the disclosed technology. All relative descriptions herein such as left, right, up, and down are with reference to the Figures, and not meant in a limiting sense. Additionally, for clarity common items such as regulators, filters, solenoids, drains, valves and the like may not have been included in the Figures as would be appreciated by those of ordinary skill in the pertinent art.

Now referring to FIG. 1, a system for distributing a fire suppressant over a hazard area, e.g., a room, is referred to generally by the reference numeral 100. The system 100 is preferably located in an unobtrusive location such as a corner 102. A pipe network 104 extends from the corner 102 over the area in which fire suppression will be supplied, i.e., the hazard area. The pipe network 104 also extends to a CAF supply 106 and to a nitrogen supply (not shown) such that CAF from the CAF supply 106 can be selectively delivered to the hazard area. Preferably, the nitrogen tank has a regulator and gauge 108 for allowing easy reading of the pressure therein. Further, the CAF supply system 106 has a redundant supply 107 of compressed air (e.g., two tanks) such that either tank can be used alone to empty the CAF vessel 109. A manifold 111 mixes the compressed air from the supply 107 with the solution of the CAF supply system 106 to create the CAF.

A pilot line 110 of the pipe network 104 has two fusible link sprinkler heads 112. In other embodiments, there are one or a plurality of fusible link sprinkler heads 112. The sprinkler heads 112 preferably are activated in response to excessive heat. In another embodiment, the pilot line 110 has at least one fixed temperature detector to generate a signal based upon sensing one or more environmental parameter. For example, the environmental parameter can be heat, smoke, $CO_2$ level, presence of a particular biohazard and the like in various combinations. Based upon a change of condition (inactive to active for the fusible link sprinkler heads 112) or a signal change, as the case may be, a control system 114 fully activates the system 100 by charging the pipe network 104 with CAF. When the pipe network 104 is charged, a plurality of open spray nozzles 116 deliver the CAF in a pattern over the hazard area.

The control system 114 has a control valve 118 connected intermediate the mixing manifold 111 and the pilot line 110 for activating the system 100 such that when the control valve 118 is open, CAF from the CAF supply 106 is allowed to enter the pipe network 104 and exit over the hazard area via the nozzles 112, 116. The control system 114 also includes a manual shut-off valve 120 connected in the pipe network 104 between the CAF supply 106 and the control valve 118. The control system 114 further includes a low air pressure switch 122 in the normally pressurized pilot line 110 for determining when pressure drops in the pilot line 110, i.e., when the fusible link sprinkler heads 112 enter an active mode. In this embodiment, it is envisioned that the signal from the low air pressure switch 122 is relayed to a microprocessor controller (not shown) for additional processing such as notification of proper authorities, triggering an audible alarm or even actuating the system 100 and the like.

Inactive Mode

When inactive, the pilot line 110 is pressurized by connection to the nitrogen tank by line 124. The fusible link sprinkler heads 112 are sealed and, thus, pressure in the pilot line 110 is maintained. As a result, the low air pressure switch 122 would indicate that the pilot line 110 is pressurized properly. This pressurized condition maintains the control valve 118 closed. The manual shut-off valve 120 is open such that opening of the control valve 118 will allow release of CAF from the CAF supply 106. Further, the control valve 118 being normally closed allows the nozzles 116 to be normally open. In another embodiment, the nozzles 116 are also heat or otherwise activated. Of course, the system 100 could be configured with normally closed nozzles 116 that are actuated individually instead of the control valve 118 as would be appreciated by those of ordinary skill in the pertinent art.

Active Mode

The system 100 switches from inactive to active upon excessive heat being present at the fusible link sprinkler heads 112. The heat opens the sprinkler heads 112 to release nitrogen such that a pressure drop occurs in the pilot line 110. In response to the pressure drop, the low air pressure switch 122 triggers an alarm condition. The alarm condition may include warning lights (not shown), sirens (not shown), an automatic contact message being sent to a proper authority and other like indicia of the alarm condition. The drop in pressure within the pilot line 110 also pneumatically triggers the control valve 118 to open. As a result, the CAF stored in the CAF supply 106 begins to flow into the pipe network 104, including the pilot line 110, and exit out the nozzles 112, 116 on to the hazard area. To shut the delivery of CAF off, the manual shut-off valve 120 is simply closed.

In another embodiment, the shut-off valve 120 is not manual and operation thereof is controlled remotely. In another embodiment, a nitrogen supply is not needed, rather the compressed air tanks 107 or downstream CAF are used to pressurize the pilot line 110. Preferably, in this version the flow and pressure are limited in the pilot line 110 by a regulator, orifice or like elements in order to preserve the compressed air and/or CAF.

Figure 2:
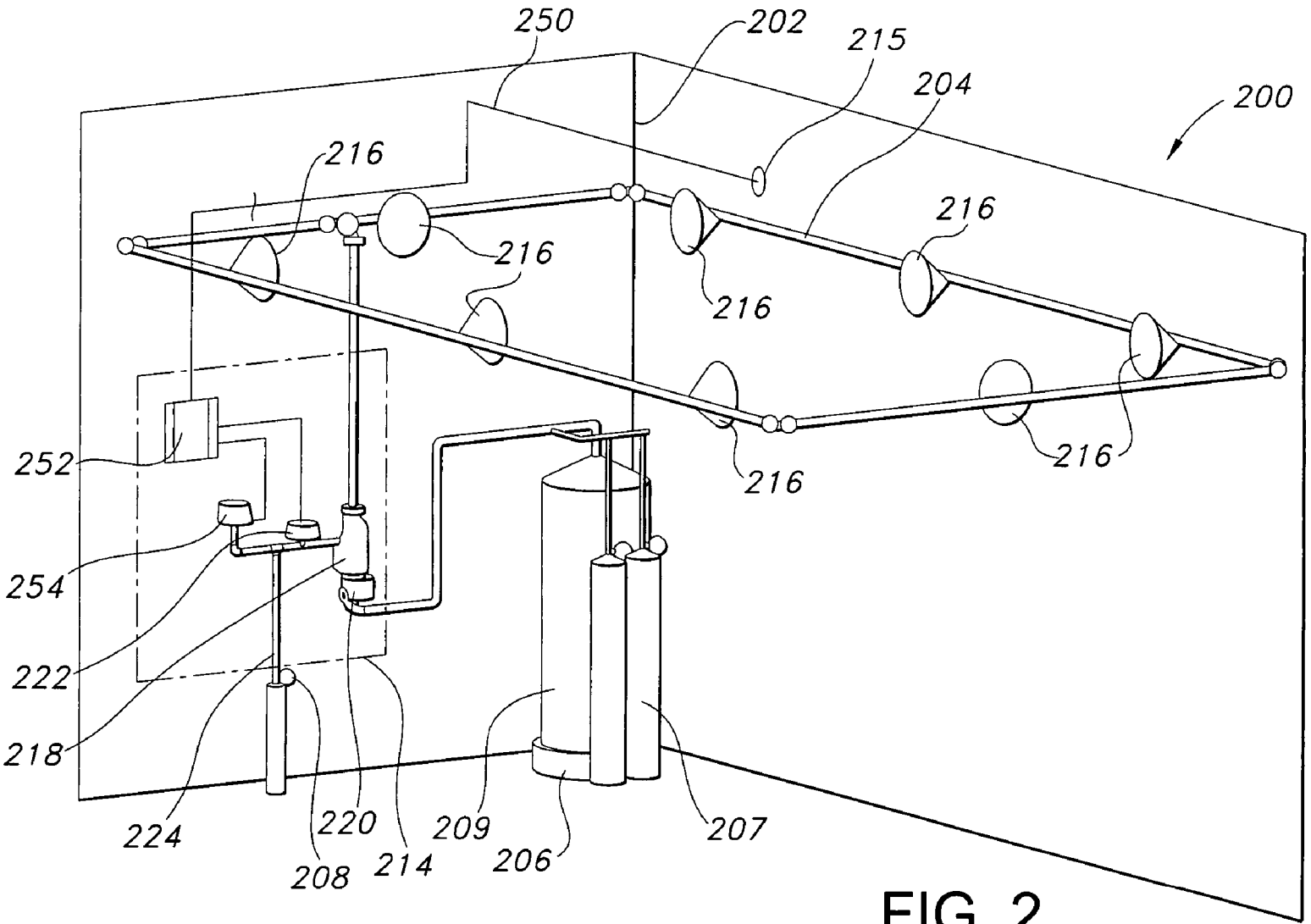
FIG. 2 illustrates still another system for distributing a suppressant over a hazard area in accordance with the subject technology.

Turning now to FIG. 2, another embodiment of a fire suppression system in accordance with the subject technology is indicated generally by the reference numeral 200. The system 200 is similar to the system 100 described above in many respects, and therefore like reference numerals preceded by the numeral "2" instead of the numerals "1" are used to indicate like elements. The primary difference of the system 200 is an electronically activated trigger mechanism as opposed to completely pneumatically actuation. For brevity, the following description is directed to the primary differences.

The control system 214 includes a control panel 252 having a processor (not explicitly shown). The control panel 252 receives and processes signals in accordance with the subject technology as would be appreciated by those of ordinary skill in the pertinent art. The control system 214 connects to a sensor(s) 215 such as a heat detector or detector wire by a line 250. The sensor generates a signal that is received by the control panel 252. The control panel 252 analyzes the signal from the sensor and based upon the signal, controls a solenoid valve 254. The solenoid 254 converts the electrical signal from the control panel 252 into a pneumatic change (e.g., a pressure drop) at the control valve 218. As a result, the pipe network 204 of the system 200 is charged with CAF that escapes via the nozzles 216 on to the hazard area. It is envisioned that the control system 314 could be housed within a cabinet, on a panel or similar to that as shown.

Figure 3:
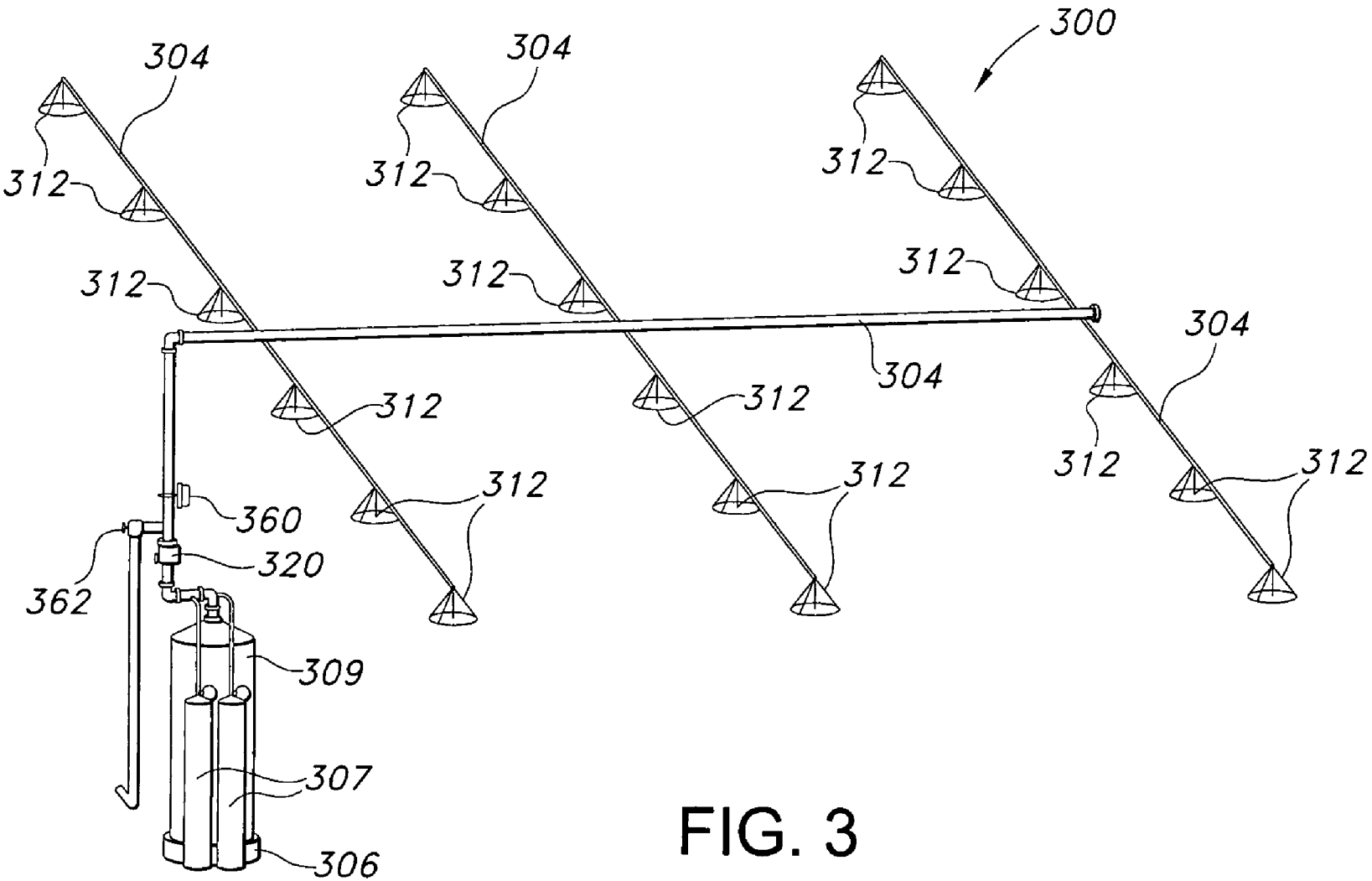
FIG. 3 illustrates yet another system for distributing a suppressant over a hazard area in accordance with the subject technology.

Referring now to FIG. 3, another embodiment of a fire suppression system in accordance with the subject technology is indicated generally by the reference numeral 300. The system 300 is similar to the systems 100, 200 described above, and therefore like reference numerals preceded by the numeral "3" instead of the numerals "2" or "1" are used to indicate like elements whenever possible. The primary difference of the system 300 is the use of fully automated fusible link sprinkler heads 312 at all locations over the hazard area. It is envisioned that only a portion of nozzles 312 of the system 300 may activate at any given time depending on the ferocity and distribution of the heat in the hazard area. As a result of the pipe network 304 having only fusible link sprinkler heads 312, the control system 314 is simplified. The control system 314 includes a flow alarm 360 for providing an audible and/or visual alarm as well as potentially providing an alarm signal to a remote location. A drain line 362 is also provided so that the pipe network 304 can be drained after use and testing.

Figure 4:
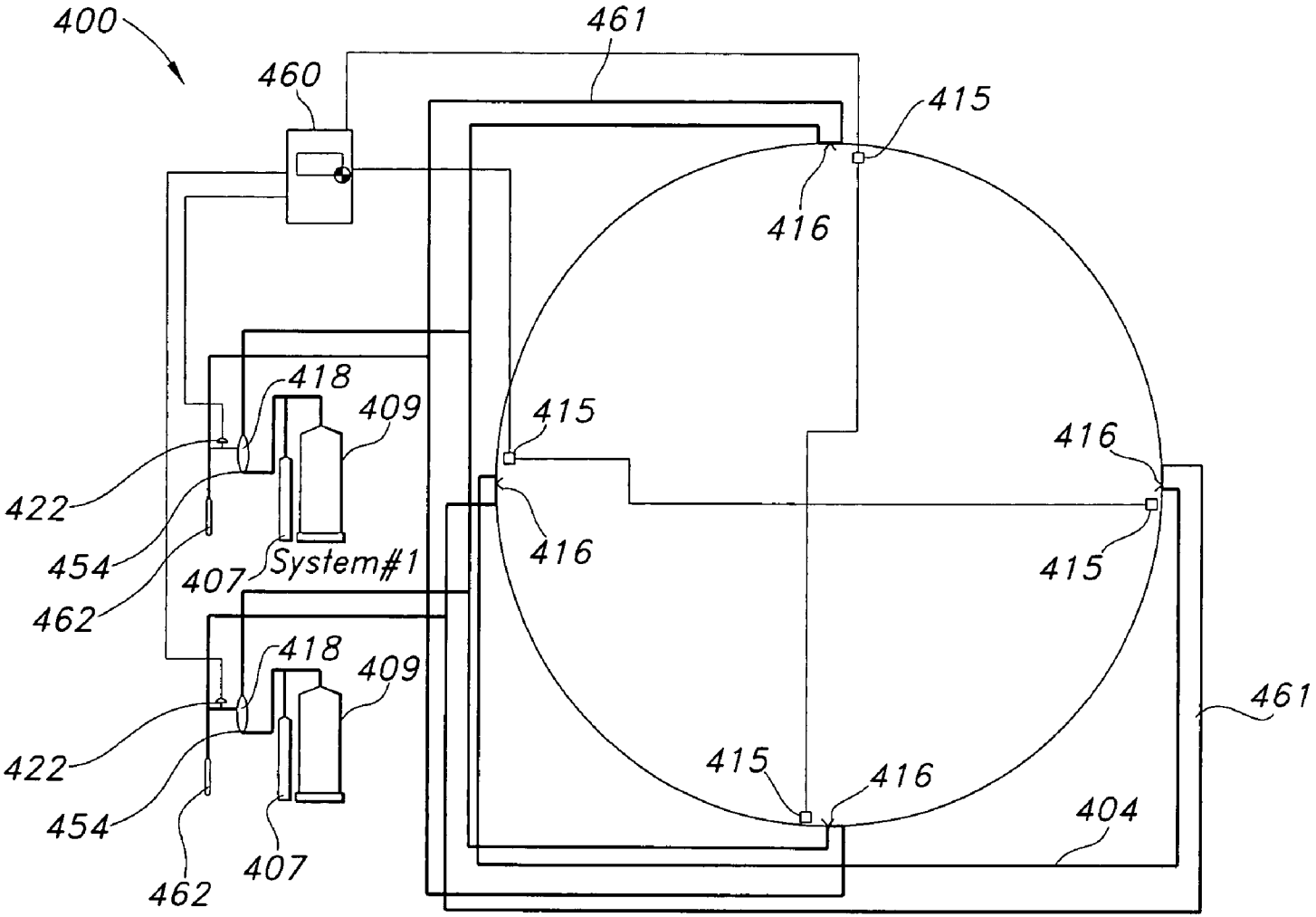
FIG. 4 illustrates another system for distributing a suppressant over a hazard area in accordance with the subject technology.

Referring now to FIG. 4, another system 400 in accordance with the subject technology is shown. As will be appreciated by those of ordinary skill in the pertinent art, the system 400 utilizes the same principles described above. Accordingly, like reference numerals preceded by the numeral "4" instead of the numeral "1", are used to indicate like elements. The primary difference of the system 400 is that the system 400 is configured to cover a hazard area with only four nozzles 416 and includes an activation panel 460.

Although shown as adjacent the nozzles 416, four IR detectors 415 form two zones and provide information on the zones to the activation panel 460. In response to the signals from the IR detectors 415, the activation panel 460 selectively activates a respective solenoid 454 to switch the control valve 418 between active and inactive modes. Preferably, the nozzles 416 rotate to expand the covered area. Flow lines 461 provide pressurized nitrogen from tanks 462 to the nozzles 416 for powering the rotational movement without reducing the pressure of the delivered CAF.

Control Panel

Figure 5:
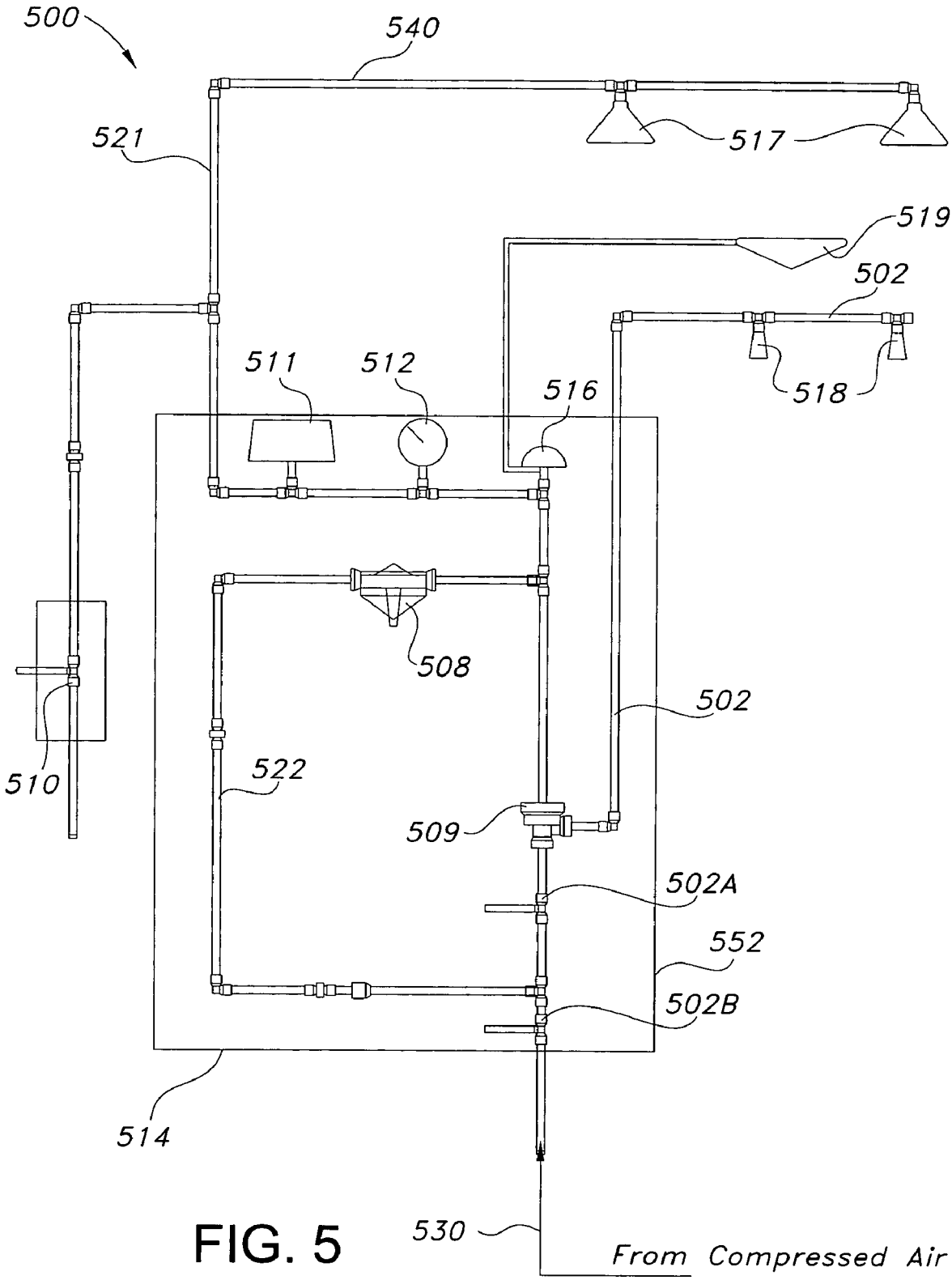
FIG. 5 illustrates still another system for distributing a suppressant over a hazard area in accordance with the subject technology.

Referring now to FIG. 5, another system 500 in accordance with the subject technology is shown. As will be appreciated by those of ordinary skill in the pertinent art, the system 500 utilizes the same principles described above. The primary difference of the system 500 is in the control panel 552. The system 500 also has a redundant automated trigger mechanism similar to that of FIG. 6 described below, which is not described here to avoid undue repetition.

Figure 5A:
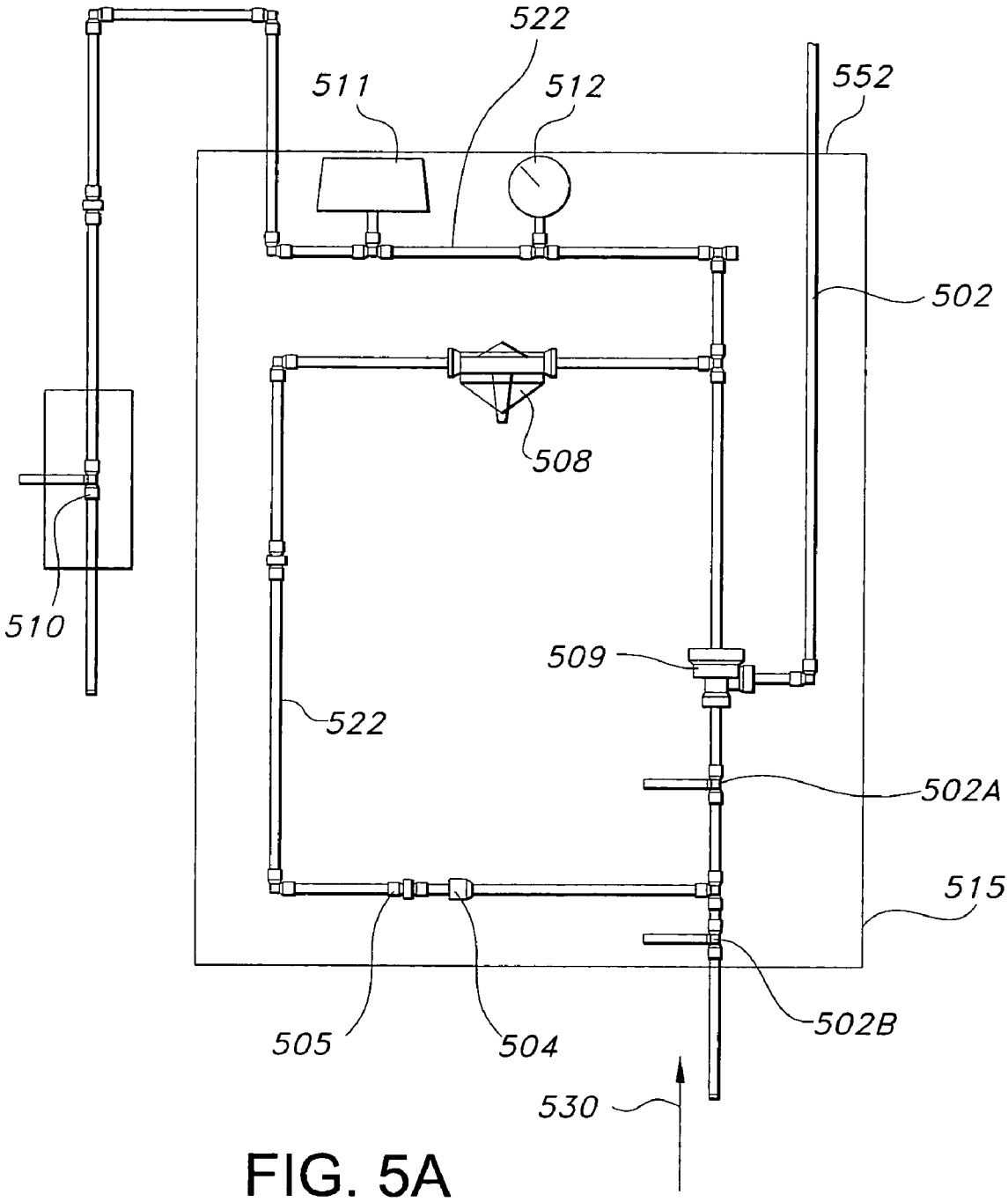
FIG. 5A is a somewhat schematic representation of a control panel for use in a system in accordance with the subject invention.

Referring now to FIG. 5A, the control panel 552 is illustrated somewhat schematically. The control panel 552 is substantially contained in a metal enclosure (not shown) and connects to the nozzles 517, 518 by piping 502 for delivering CAF from the source along arrow 530. A control valve 509 selectively opens to release the CAF. The flow of CAF to the control valve 509 can be shut off by either of two ball valves 502A, 502B. To initially set up the control panel 552, ball valve 502A is closed and ball valve 502B is opened to allow CAF to pass into piping 522. A restrictor 504 limits flow and a check valve 505 prevents backflow. Further, a pressure regulator 508 drops the supply pressure. In a preferred embodiment, the pressure regulator 508 drops the supply pressure from about 160 lb. to about 45 lb. Thus, the 45 lb pressure is applied to the top side of the control valve 509 to close the control valve 509. Once closed, ball valve 502A can be opened and the control valve 509 will otherwise remain closed. Piping 522 includes a gauge 512 to allow reading the pressure therein.

To activate the system, a pressure switch 511 in the piping 522 further indicates a pressure drop and can provide a signal related to same. Piping 522 is connected to a release valve (not shown) or pilot line (not shown) such that upon sensing of heat, the pressure therein is dropped to open the control valve 509 and thus activate the system 500 attached thereto. A manual emergency activation valve 510 allows activating the system by creating a pressure drop upon actuation in a manner well known to those of ordinary skill in the pertinent art.

Figure 6:
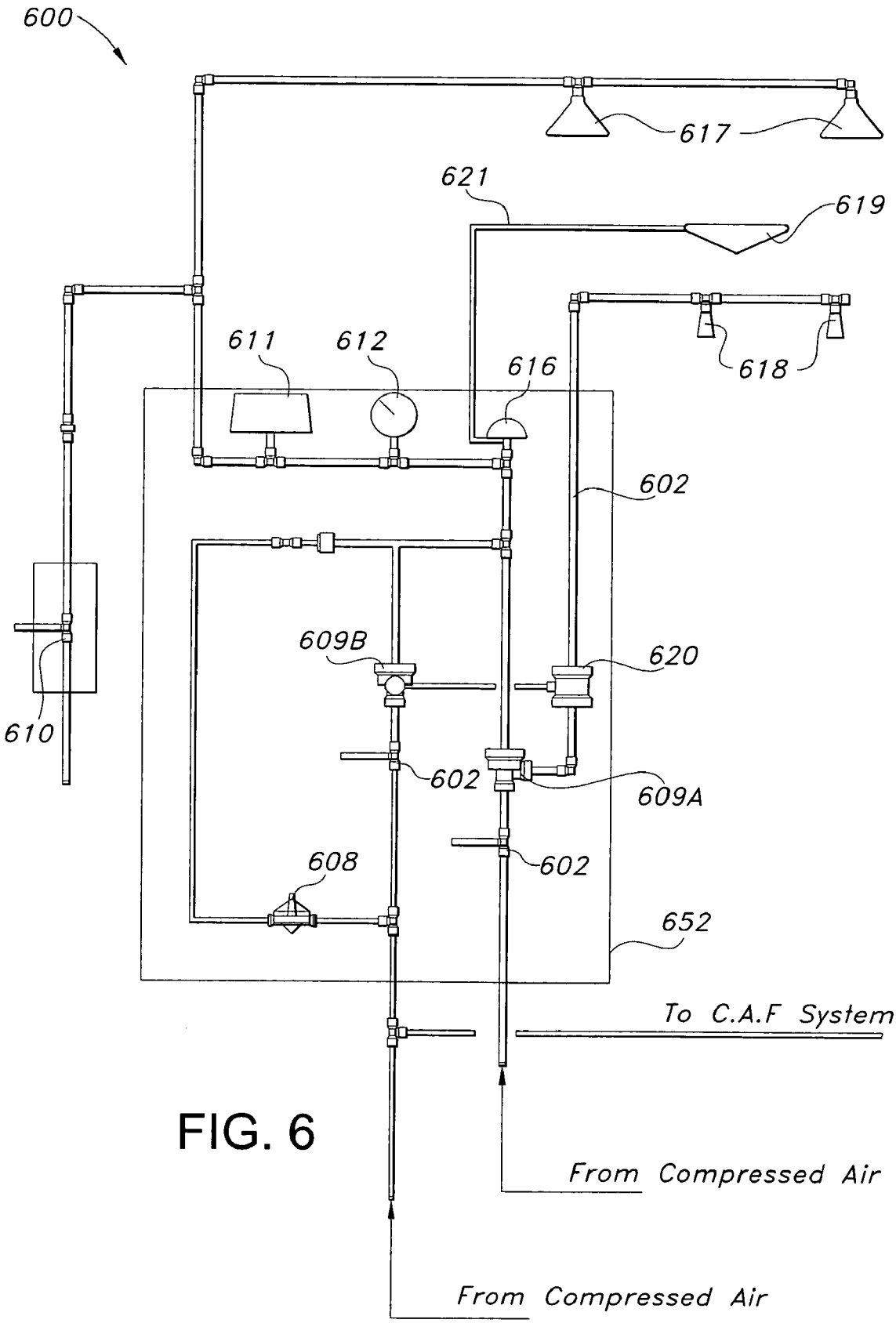
FIG. 6 illustrates still another system for distributing a suppressant over a hazard area in accordance with the subject technology.

Referring to FIG. 6, another system 600 having another modified control panel 652 in accordance with the subject technology is shown. As will be appreciated by those of ordinary skill in the pertinent art, the panel 600 utilizes many of the same principles described above. Accordingly, like reference numerals preceded by the numeral "6" instead of the numeral "5", are used to indicate like elements whenever possible. A primary enhancement of the system 600 is a redundant automatic trigger mechanisms and dual control valves 609A, 609B.

One trigger mechanism is an electric heat detector 619 that activates a solenoid 616 to lower pressure on the top side of the control valves 609A, 609B. When top side pressure on the control valves 609A, 609B is reduced, the control valves 609A, 609B open to allow CAF to pass into the fixed piping 602 having nozzles 618 disposed therein. A second trigger mechanism is a pneumatic pilot line 621 having fixed temperature sensors 617. In one embodiment, the fixed temperature sensors 617 mechanically release to reduce top side pressure on the control valves 609A, 609B in response to elevated pressure.

Still referring to FIG. 6, another primary enhancement of the panel 600 is that the panel 600 has relocated the ½" Watt Pressure Regulator 608 and the secondary additional CAF Control Valve 609B with associated CAF Manifold 620. The CAF Control Valves 609A, 609B are separately connected to the compressed air (not shown) and foam supply (not shown). When both CAF Control Valves 609 are actuated, compressed air and foam supply are fed into the CAF Manifold 620. Thus, the compressed air foam is created downstream of the CAF Control Valves 609, which can cause diminished performance of the compressed air foam when passing therethrough.

Figure 7:
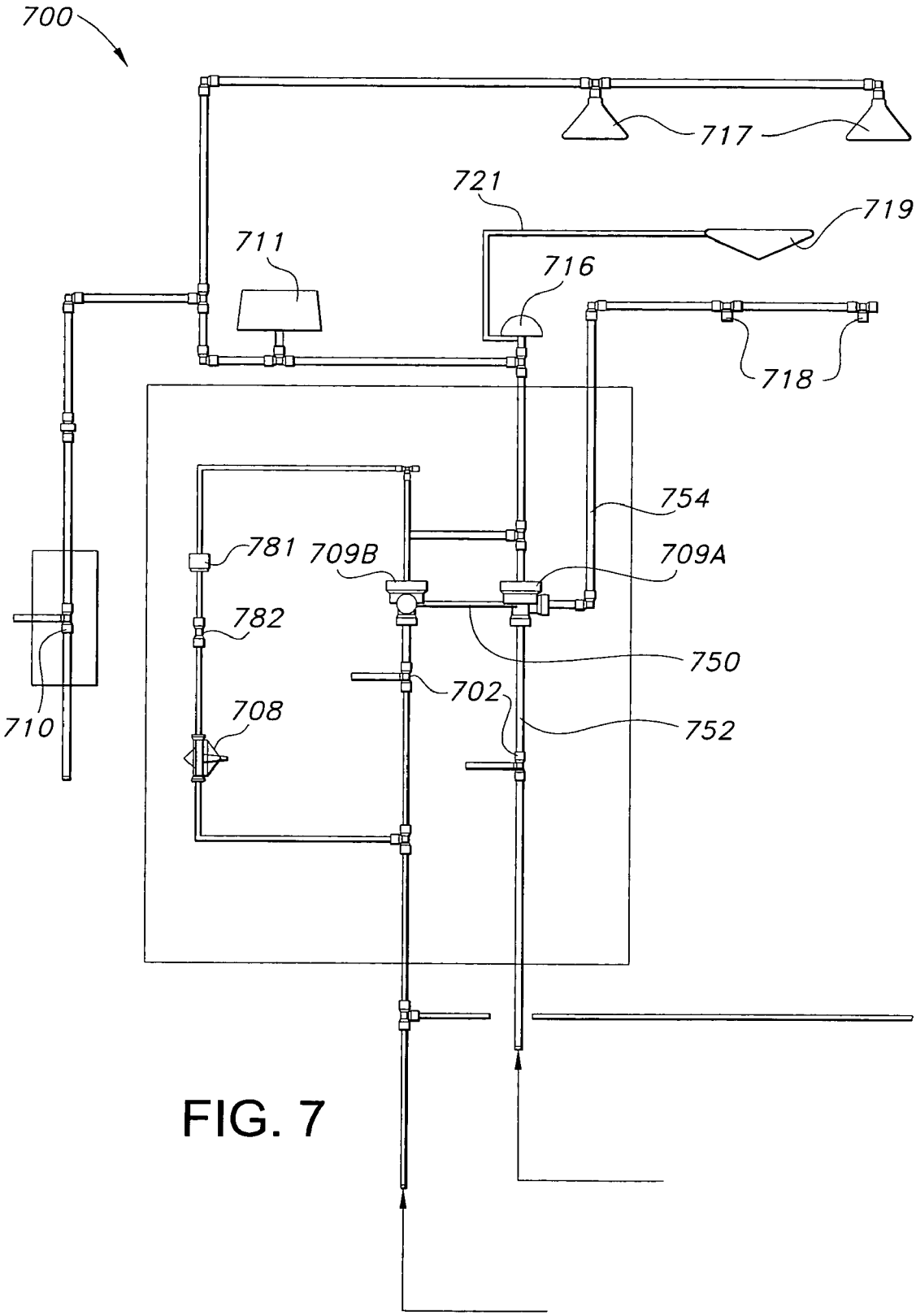
FIG. 7 illustrates still another system for distributing a suppressant over a hazard area in accordance with the subject technology.
Figure 7A:
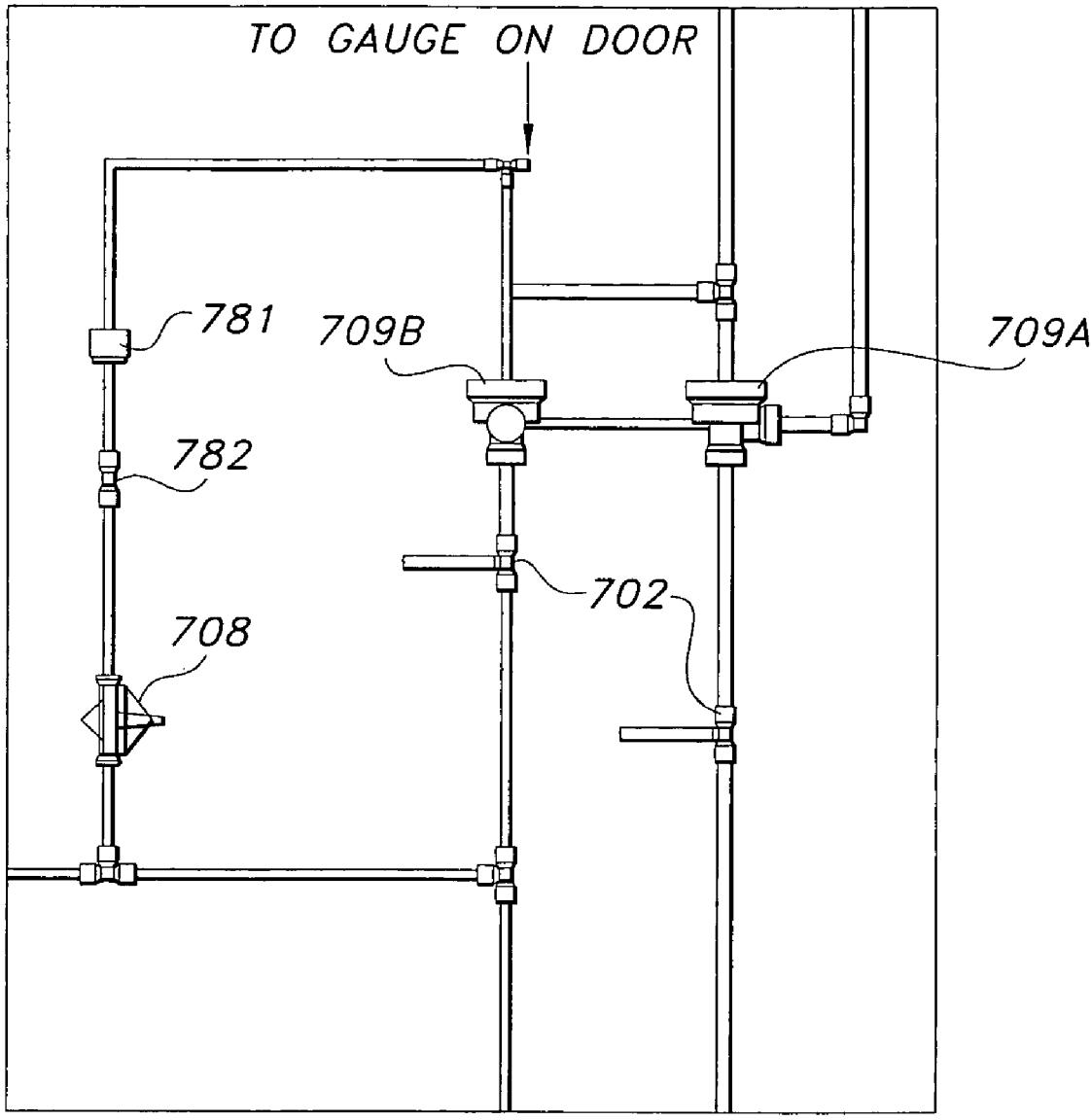
FIG. 7A is a somewhat schematic representation of a control panel for use in a system in accordance with the subject invention.

Referring now to FIGS. 7 and 7A, another embodiment of a fire suppression system 700 and control panel 714, respectively, are shown. The system 700 is similar to the systems described above, and therefore like reference numerals are used to indicate like elements whenever possible. The primary difference of the system 700 is the control panel 714 having a modified control valve 709A that serves to activate the system 700 as well as mix the compressed air with CAF solution. Piping 750 extends from the control valve 709B such that when 709B is activated to allow compressed air there through, the compressed air enters the control valve 709A via piping 750. When the control valve 709A is activated, the CAF solution also enters the control valve 709A via piping 752 and mixes with the compressed air therein. The CAF resulting from the mixing within the control valve 709A is distributed through piping 754. As a result of the modified control valve 709A, the control system 714 is simplified in that a separate manifold is not required. In another embodiment, the control valve 709B is not required and the compressed air is simply plumbed directly to the modified control valve 709A. The system 700 also includes a restrictor 781 and check valve 782.

Figure 8:
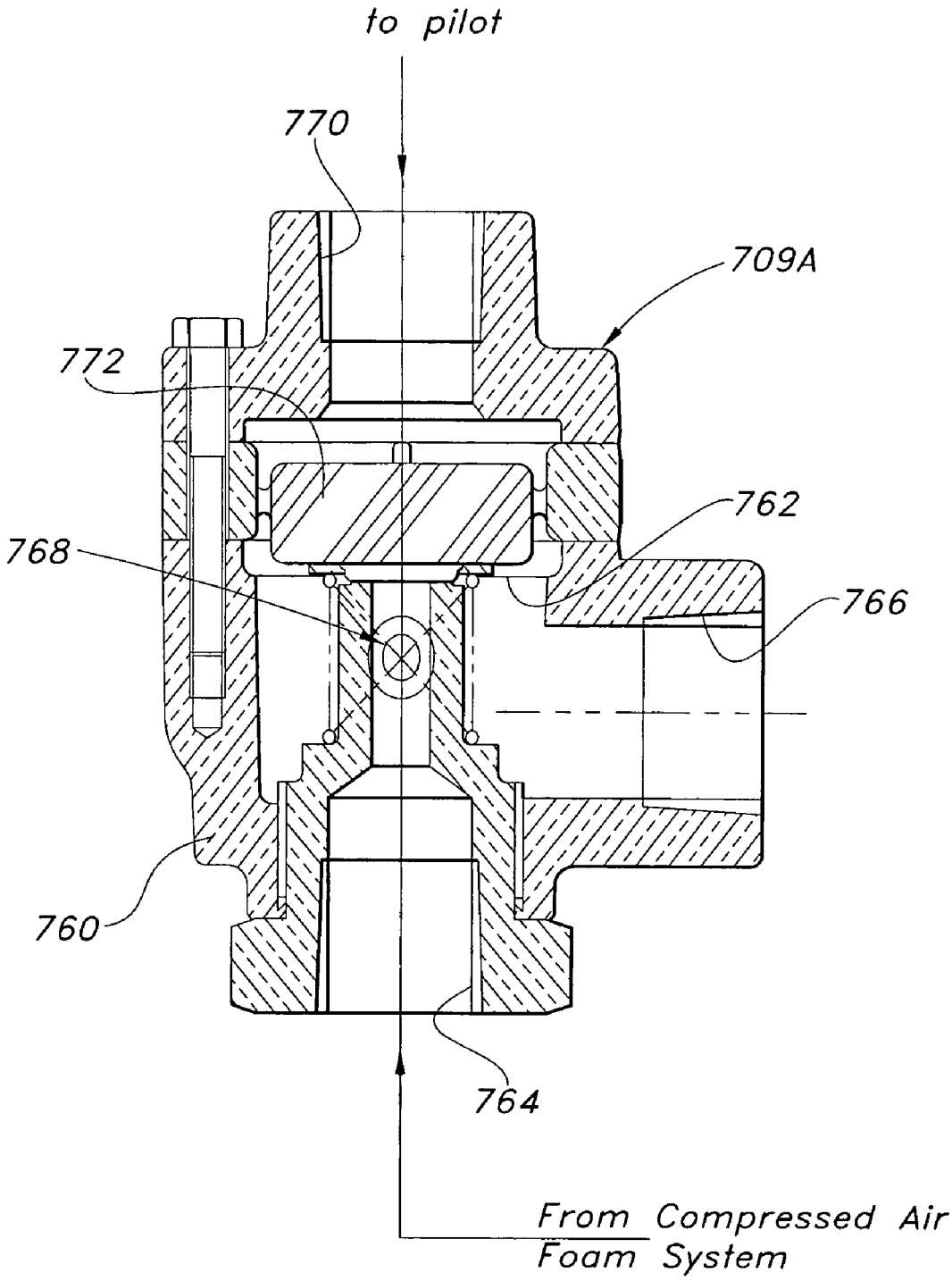
FIG. 8 is a cross-sectional view of the mixing manifold valve of FIGS. 7 and 7A.

Referring now to FIG. 8, a cross-sectional view of the mixing manifold control valve 709A of FIGS. 7 and 7A is shown. The modified control valve 709A includes a housing 760 defining an interior 762 in communication with inlets and outlets. A first inlet 764 is connected to the CAF foam supply by the piping 752 and a second inlet 768 is connected to the compressed air supply by the piping 750. A first outlet 766 is connected to the fixed piping 754 having spray nozzles 718 and a combination inlet/outlet 770 is connected to the pilot line 721.

As described above, the control valve 709A is normally-open but a pressure in the pilot line 721 and, in turn, combination inlet/outlet 770 maintains a passageway from the first inlet 764 and second inlet 768 to the first outlet 766 and combination inlet/outlet 770 blocked. To open the passageway and thereby allow the compressed air and CAF to mix in the interior 762, a valve member 772 moves linearly from the closed to open position (e.g., inactive to active). Preferably, the first inlet 764 is aligned with the combination inlet/outlet 770. In contrast, the first outlet 766 and second inlet 768 are not only substantially perpendicular to the axis 774 but also substantially perpendicular with respect to each other. Thus, the compressed air and CAF solution enter the interior 762 at right angles with respect to each other and mix vigorously in the interior 762 to provide a thick CAF.

Referring now to FIGS. 9A-E, several additional embodiments of modified mixing control valves are shown. As would be evident to one of ordinary skill in the pertinent art, FIGS. 9A-E are drawn in somewhat schematic form to clearly illustrate the necessary concepts and further elaboration is not required as the actual fabrication would be well within the skill of one of ordinary skill in the art based upon review of the subject disclosure.

Figure 9A:
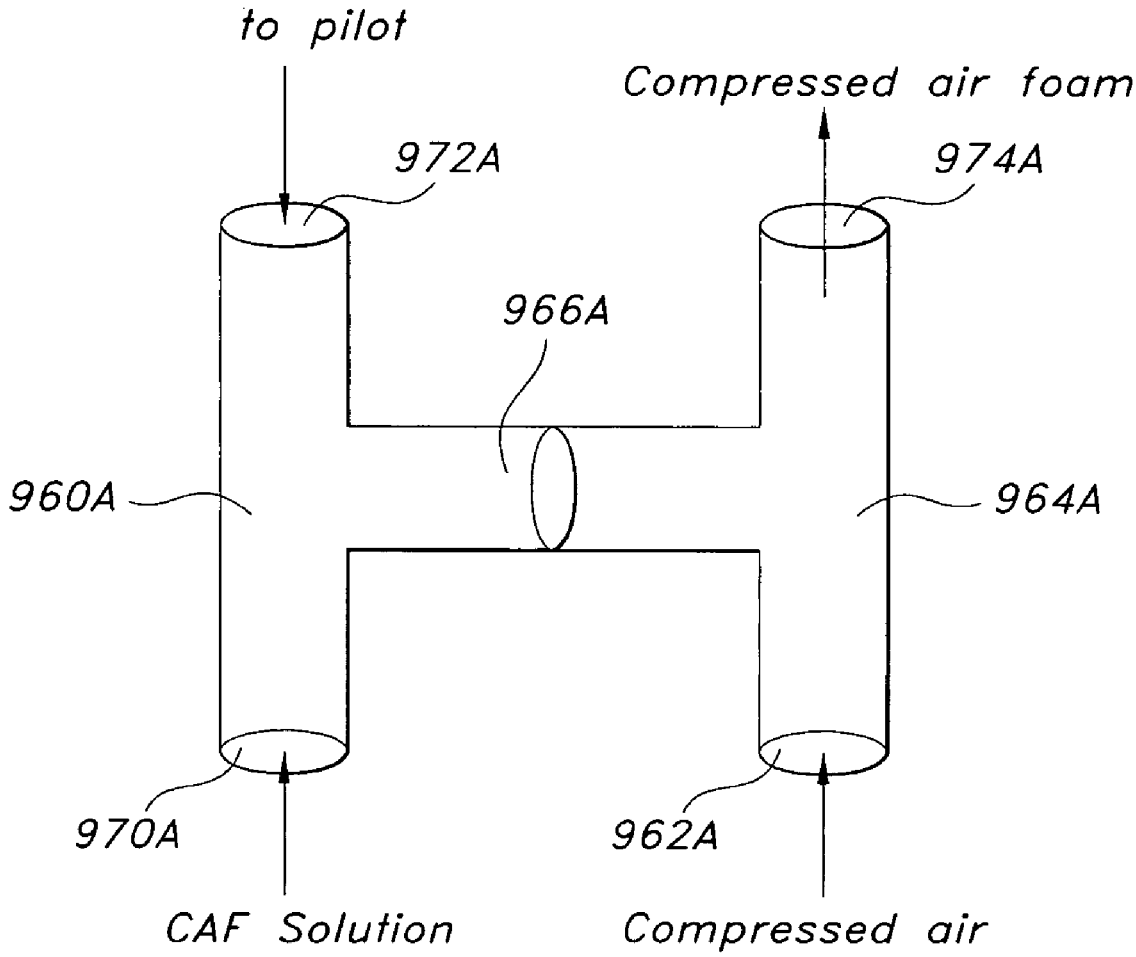
FIGS. 9A-E are various views of alternative arrangements for configuring a mixing manifold valve for use with the subject technology.

Referring now particularly to FIG. 9A, an alternative arrangement of a control valve 960A is shown having a T-shaped connector 964A to defined the additional inlet 962A. The T-shaped connector 964A attaches to the valve outlet 966A. When the control valve 960A opens along with the valve (not shown but controlling the compressed air), the compressed air and CAF solution vigorously mixes within the T-shaped connector 964A to provide the CAF via outlet 974A. Additionally, the control valve 960A defines an inlet 972A for the CAF solution and a pilot opening 972A in communication with the pilot piping (not shown) to actuate the valve 960A. Again, any detrimental effects from passing the CAF through the control valve 960A are overcome by having the creation of the CAF occur downstream therefrom. Moreover, a separate manifold to mix the components of CAF is not required but rather a simple T-shaped connector 964A.

Figure 9B:
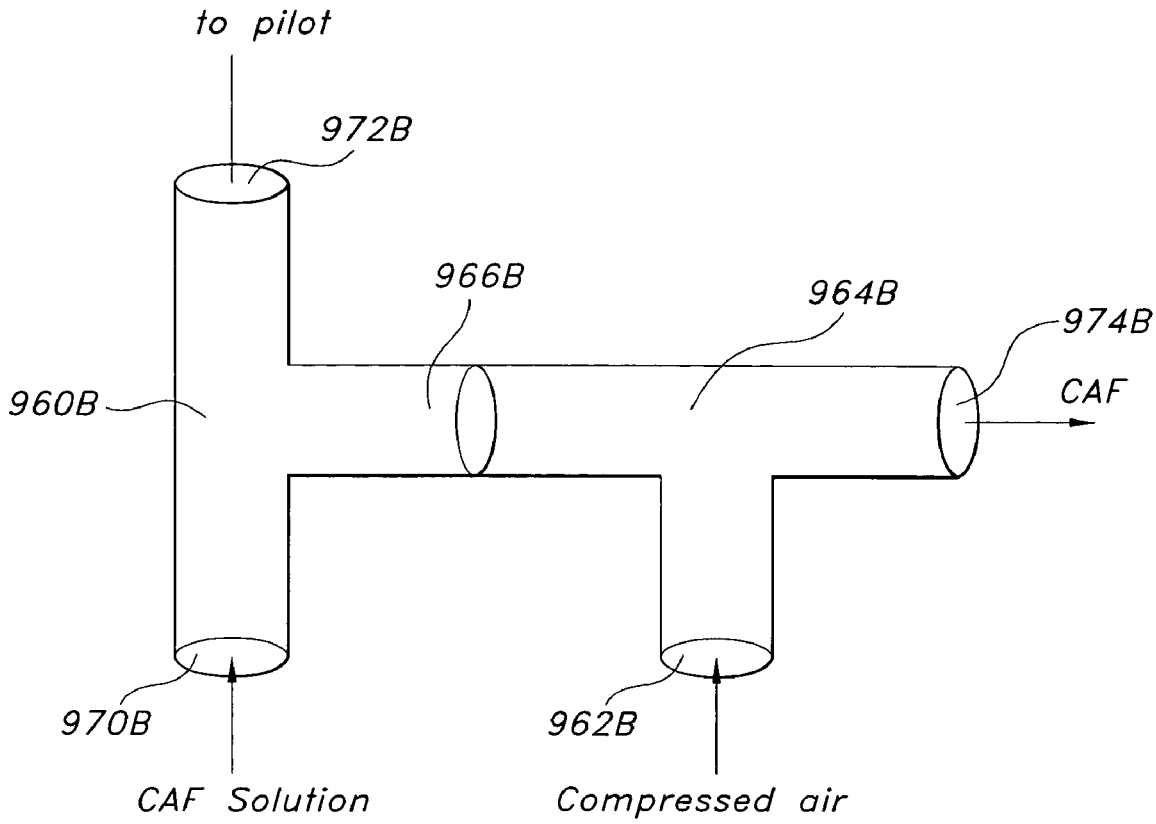
Figure 9C:
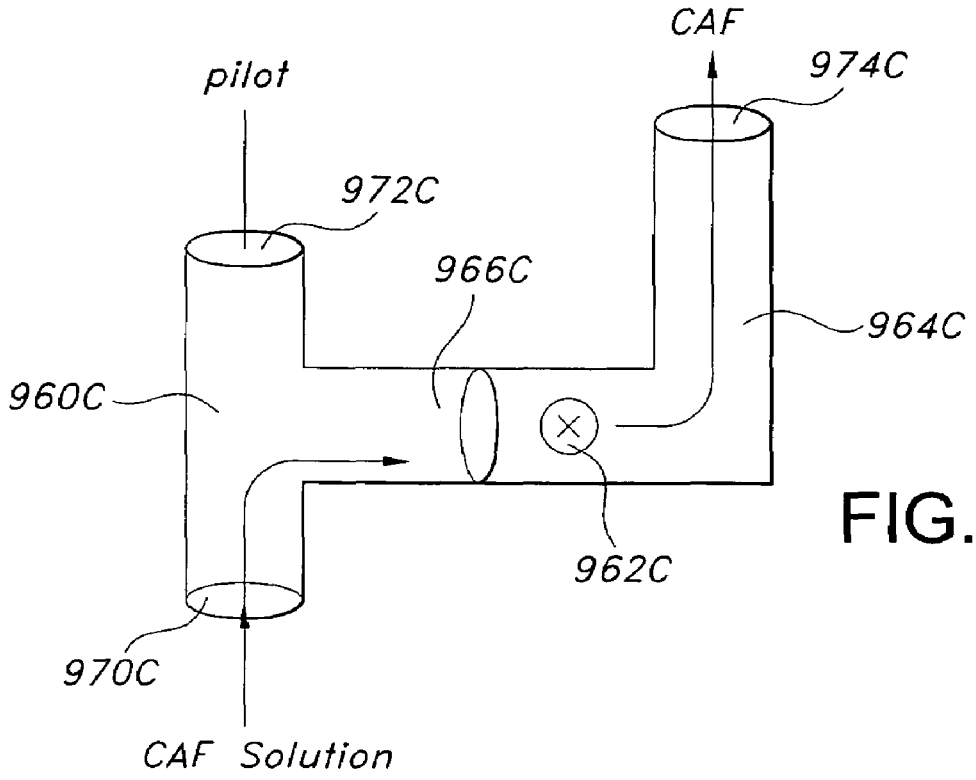
Figure 9D:
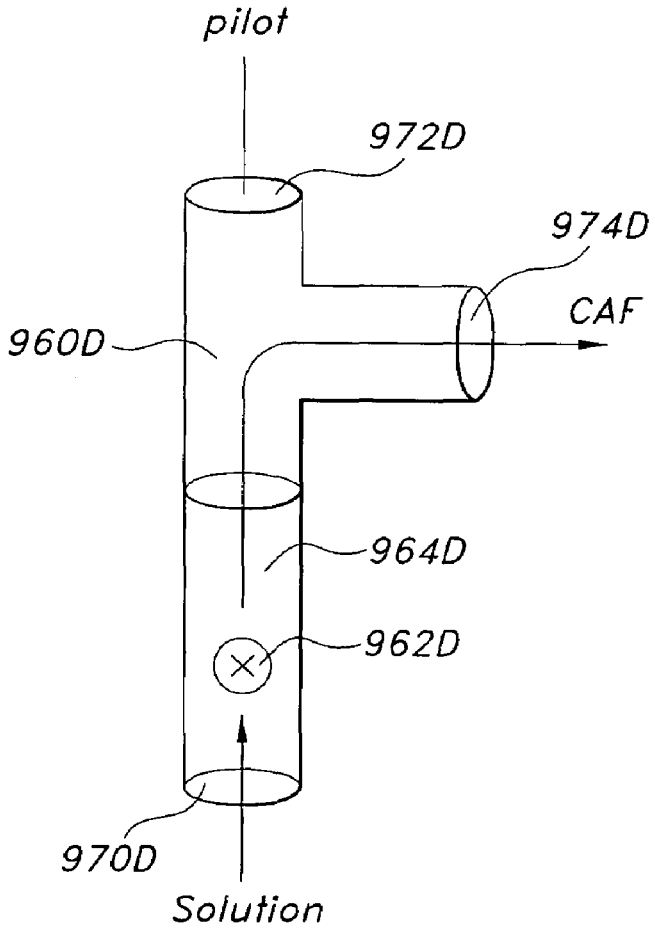
Figure 9E:
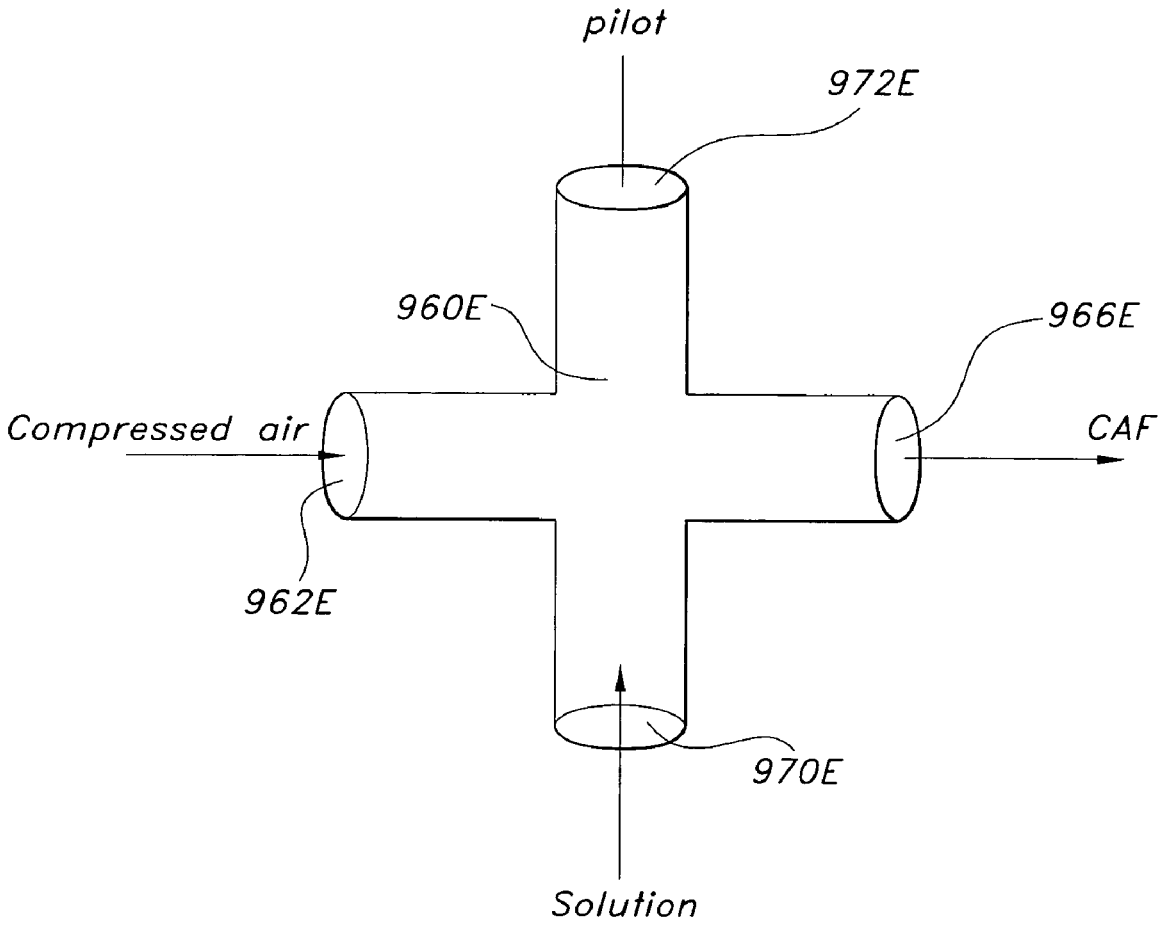

FIG. 9B illustrates another alternative similarly simplified arrangements for using a T-shaped connector 964B with a control valve 960B and like reference numerals having a "B" appended instead of an "A" are utilized to identify like parts. The T-shaped connector 964 is mounted so that the compressed air is substantially perpendicular to the flow of CAF as opposed axially aligned with the flow of CAF. FIGS. 9C and 9D illustrate still additional embodiment to utilize a T-shaped connector 964C, 964D with a valve 960C, 960D, respectively. Like reference numerals have a respective "C" or "D" appended instead of an "A" or "B" to identify like parts. It is noted that in each case the compressed air inlet 962C, 962D would indicate an in-flow oriented into the page of the respective figure.

Referring now to FIG. 11E, still another version of a control valve 960E is shown with the numeral "E" appended to like reference numbers. The control valve 960E has a housing that defines the compressed air inlet 962E, the CAF solution inlet 970E, the pilot opening 972E and the CAF outlet 966E. Accordingly, the mixing occurs within the valve 960E and a separate T-shaped connector or manifold is not required.

It would be recognized by those of ordinary skill in the art that linear and rotary, normally-closed, normally-open and like control valves could be easily adapted to provide the benefits and features described herein and such modifications are well within the contemplated scope of the subject technology.

It is envisioned that the subject technology has wide application. In another embodiment, an indoor fire suppression system and an outdoor fire suppression system in accordance with the subject disclosure share a single CAF source. Another application for the subject technology is in skyscrapers. For a skyscraper, each floor can have an independent suppression system to alleviate the need for long vertical supply pipes which if broken cannot provide fire suppression as intended. Another application is fire suppression in the engine compartment of logging and other heavy industrial equipment to preserve the equipment, allow safe shutdown and prevent injury to workers. For another example, the subject technology may be used to cover and/or control release of a biohazard in a laboratory. Such a system would blanket the laboratory with a disinfecting agent that encapsulates to contain release of the substance. In still another embodiment, the control panel is self powered by one or more of a battery, solar power, wind power and the like. In another embodiment, the heat detection sensor is a UV or IR heat detector.

While the invention has been described with respect to preferred embodiments, those skilled in the art will readily appreciate that various changes and/or modifications can be made to the invention without departing from the spirit or scope of the invention. For example, aqueous film forming foam, halogen and the like may be delivered by systems in accordance with the subject technology as would be appreciated by those of ordinary skill in the pertinent art based upon review of the subject disclosure.

What is claimed is:

1. A system for automatically distributing compressed air foam (CAF) over a hazard area comprising:

a pipe system;

a supply of CAF solution and compressed air connected to the pipe system;

a plurality of spray nozzles connected to the pipe system for delivering a pattern of the CAF to the hazard area;

a control system connected to the pipe system for selectively charging the pipe system with the CAF, wherein the control system includes: i) a pilot line connected to the control system for generating a signal based upon sensing at least one environmental parameter; and ii) a first control valve for automatically activating the system based upon the signal and making the CAF, wherein the pilot line and the first control valve are pneumatically actuated and wherein the first control valve forms: i) an empty interior cavity for mixing compressed air and liquid to create the CAF, ii) an outlet in fluid communication with the interior cavity; iii) a first inlet oriented substantially perpendicular to a flow through the outlet and in fluid communication with the interior and a supply of the compressed air; and iv) a second inlet oriented substantially perpendicular to the flow through the outlet and the first inlet, the second inlet in fluid communication with the interior and a supply of the liquid, wherein the first inlet and the second inlet are at right angles with respect to each other.

2. A system as recited in claim 1, wherein the environmental parameter is selected from the group consisting of heat, smoke, $CO_2$ level and combinations thereof.

3. A system as recited in claim 1, further comprising a manual shut-off valve connected within the control system.

4. A system as recited in claim 1, further comprising a second control valve for selectively controlling the compressed air based upon the signal.

5. A system as recited in claim 1 further comprising a T-shaped fitting in fluid communication with the outlet and the compressed air.

6. A system as recited in claim 5, wherein the compressed air enters the T-shaped fitting substantially parallel a flow therethrough.

7. A system as recited in claim 5, wherein the compressed air enters the T-shaped fitting substantially perpendicular a flow therethrough.

8. A system as recited in claim 1, wherein the first control valve forms: i) an interior cavity for mixing the compressed air and compressed air liquid, ii) an outlet in fluid communication with the interior; iii) a first inlet, oriented substantially perpendicular to a flow through the outlet, in fluid communication with the interior and the compressed air; and iv) a second inlet, oriented substantially parallel to the flow, in fluid communication with the interior and the compressed air liquid.

9. A system as recited in claim 1 further comprising a three-way corner fitting in fluid communication with the outlet and the compressed air.

10. A system as recited in claim 1, further comprising a three-way corner fitting in fluid communication with the inlet and the compressed air.

11. A system as recited in claim 1, system further includes a second control valve connected to a liquid foam supply and a manifold connected downstream of the first and second control valves for creating compressed air foam downstream of the first and second control valves.

12. A system as recited in claim 1, wherein the CAF is a biohazard suppressant.

13. A fire suppressant system for distributing compressed air foam (CAF) over a hazard area comprising:

a pipe system;

a plurality of spray nozzles connected to the pipe system for delivering a pattern of the CAF to the hazard area;

a control valve connected to the pipe system for selectively generating the CAF and charging the pipe system with the CAF, wherein the control valve operates in: i) an inactive mode where the control valve is closed; and ii) an active mode where the control valve mixes compressed air and solution to form the CAF and provide the CAF to the pipe system, wherein the control valve forms: i) an empty interior cavity for mixing compressed air and liquid to create the CAF, ii) an outlet in fluid communication with the interior cavity; iii) a first inlet oriented substantially perpendicular to a flow through the outlet and in fluid communication with the interior and a supply of the compressed air; and iv) a second inlet oriented substantially perpendicular to the flow through the outlet and the first inlet, the second inlet in fluid communication with the interior and a supply of the liquid, wherein the first inlet and the second inlet are at right angles with respect to each other; and a control system to automatically trigger the control valve from the inactive mode to the active mode based upon an environmental parameter indicating fire.

14. A fire suppressant system as recited in claim 13, wherein the control system includes a processor for transitioning the control valve and a sensor for providing the environmental parameter.

15. A fire suppressant system as recited in claim 13, wherein the control system further includes a solenoid for converting an electrical activation signal from the processor into a pneumatic charge to transition the control valve from the inactive mode to the active mode.

* * * * *